US007874972B2

(12) United States Patent
Hayasaka et al.

(10) Patent No.: US 7,874,972 B2
(45) Date of Patent: Jan. 25, 2011

(54) CENTRIFUGE WITH LID LOCKING MECHANISM

(75) Inventors: Hiroshi Hayasaka, Ibaraki (JP); Hiroyuki Takahashi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 509 days.

(21) Appl. No.: 12/037,548

(22) Filed: Feb. 26, 2008

(65) Prior Publication Data

US 2008/0220958 A1 Sep. 11, 2008

(30) Foreign Application Priority Data

Feb. 28, 2007 (JP) ..... P2007-048428

(51) Int. Cl.
*B04B 7/06* (2006.01)

(52) U.S. Cl. ..... 494/12; 70/278.7; 70/432; 292/201

(58) Field of Classification Search ..... 494/1, 494/7–12, 16–21, 31, 33, 84; 210/85, 144, 210/363; 70/84, 159, 277, 278.7, 432; 292/201, 292/194, 202, 203, 44, 49, 196, 97, 116, 292/117, 213

See application file for complete search history.

(56) References Cited

U.S. PATENT DOCUMENTS 2,399,812 A * 5/1946 Ledin ..... 70/84
3,633,041 A * 1/1972 Koskela ..... 307/119
3,866,825 A * 2/1975 Balazer et al. ..... 494/12
4,345,713 A * 8/1982 Gutierrez et al. ..... 494/12
5,280,975 A * 1/1994 Tscheu et al. ..... 292/251
6,056,684 A * 5/2000 Linder et al. ..... 494/12
6,241,650 B1 * 6/2001 Letourneur ..... 494/11
6,315,336 B1 * 11/2001 Swartzell ..... 292/201
6,334,841 B1 * 1/2002 Letourneur ..... 494/11
7,278,961 B2 * 10/2007 Takahashi et al. ..... 494/12
7,288,060 B2 * 10/2007 Takahashi ..... 494/12
7,311,653 B2 * 12/2007 Kusumoto ..... 494/16
7,334,823 B2 * 2/2008 Courter et al. ..... 292/201
7,500,942 B2 * 3/2009 Takahashi et al. ..... 494/12
2001/0024039 A1 * 9/2001 Lippoldt et al. ..... 292/197

(Continued)

FOREIGN PATENT DOCUMENTS

DE 2816395 A1 * 10/1979

(Continued)

*Primary Examiner*—Charles E Cooley
(74) *Attorney, Agent, or Firm*—McDermott Will & Emery LLP

(57) ABSTRACT

A centrifuge includes: a rotation room chamber for defining a rotation room; a lid for closing the rotation room; a locking mechanism configured by a hook for locking the lid in a closed state; a hook catch; a driving mechanism having a link mechanism which converts the rotary movement of the driving shaft portion into a reciprocal movement; and a detection portion for detecting the engagement of the hook with the hook catch in the closed state of the lid. The detection portion includes a disc member fixed to the driving shaft portion and has a concavo-convex outer peripheral surface and sensors for detecting the concave and convex portions. The driving mechanism moves in an interlocked manner with the rotation of the disc member. The positions of the concave and convex portions of the disc member correspond to the position where the hook engages.

8 Claims, 5 Drawing Sheets

U.S. PATENT DOCUMENTS

| | | | | |
|---|---|---|---|---|
| 2006/0166801 | A1* | 7/2006 | Takahashi | 494/12 |
| 2006/0178253 | A1* | 8/2006 | Takahashi et al. | 494/12 |
| 2008/0132395 | A1* | 6/2008 | Takahashi et al. | 494/7 |
| 2008/0220958 | A1* | 9/2008 | Hayasaka et al. | 494/7 |
| 2008/0305938 | A1* | 12/2008 | Hayasaka | 494/12 |

FOREIGN PATENT DOCUMENTS

| | | | |
|---|---|---|---|
| JP | 04227079 | A * | 8/1992 |
| JP | 2001-300350 | | 10/2001 |

* cited by examiner

CENTRIFUGE WITH LID LOCKING MECHANISM

CROSS-REFERENCE TO RELATED APPLICATIONS

This application is based on and claims the benefit of priority from the prior Japanese Patent Application No. 2007-048428, filed on Feb. 28, 2007; the entire contents of which are incorporated herein by reference.

TECHNICAL FIELD

The present invention relates to a centrifuge.

BACKGROUND

In general, a centrifuge used in a laboratory etc. is held in a state where a lid is closed automatically so that a rotor being rotated is not touched. As methods for the locking, there are a type where the lid is merely hooked by a latch etc. and another type where a locking mechanism operates automatically so as not to be opened manually by detecting the closed state of the lid.

It is disclosed that the driving portions for the locking portions are a type where the lid is merely latched by a reciprocal operation using an electromagnetic solenoid and another type where the lid is pulled by using a motor so as to be completely closed in a sealed manner disclosed by JP-A-2001-300350. In recent years, the consideration to the safety has been increased in the centrifuge. The centrifuge is configured in a manner that fragments are not scattered outside of the centrifuge even when a rotor is broken during the rotation. In a view point of enhancing the sealing property, the locking mechanism of the motor driving type having a large sealing force.

SUMMARY

As descried above, although some types of the locking mechanisms using motors have been used practically, since the mechanism is required to be safety in a failure state, the mechanism becomes complicated and the number of sensors etc. becomes large. For example, the number of positions where the motor is stopped is required to be at least two, that is, a lock position and a unlock position, and so sensors are required in correspondence to these positions. Further, backup sensors are required in the case of the failure of the sensors. Although the mechanism is required to cope with the failure when the sensors can not cope therewith, the mechanism is required to be complicated in order to realize such the mechanism.

Accordingly, an object of the invention is to provide a centrifuge which realizes the locking mechanism of a lid with a simplified configuration and is safety and high in reliability.

In order to solve the aforesaid problem, the invention provides a centrifuge which includes:

a housing;

a rotor which is rotatable and to which a sample vessel containing a sample therein is attached;

a rotation room chamber which defines a rotation room that is provided within the housing and houses the rotor therein;

a lid capable of opening and closing the rotation room selectively;

a locking mechanism which is configured by an engaging portion which is provided at one of the housing and the lid in order to lock the lid in a closed state and an engaged portion which is provided at the other of the housing and the lid and with which the engaging portion engages;

an engaging portion driving mechanism which includes a driving portion having a driving shaft portion being driven and rotated and a link mechanism which converts a rotary movement of the driving shaft portion into a reciprocal movement and is coupled to the engaging portion; and a detection portion which detects that the engaging portion moves to a position where the engaging portion engages with the engaged portion in a closed state of the lid, wherein the detection portion includes a detected member which is fixed to the driving shaft portion and has a concavo-convex outer peripheral surface and at least one sensors for detecting a concave portion or a convex portion of the detected member, the engaging portion driving mechanism moves in an interlocked manner with a rotation of the detected member, and positions of the concave portion and the convex portion correspond to a position where the engaging portion engages with the engaged portion.

According to such a configuration, since the rotation position of the driving shaft portion can be grasped with a simplified configuration, the position of the engaging portion moving in accordance with the rotation of the driving shaft portion can also be grasped. Thus, the movement of the engaging portion can be inhibited in a state that it is dangerous to separate the engaging portion from the engaged portion.

In the centrifuge configured in the aforesaid manner, the sensor is configured by a first sensor and a second sensor which are disposed so as to be separated by a predetermined angle therebetween around the driving shaft portion, and wherein the concave portion is configured by a first concave portion and a second concave portion which are notched over angles smaller than the predetermined angle.

According to such a configuration, it is prevented that the first and second concave portions are simultaneously detected by the first and second sensors, respectively. Thus, since the detection patterns of the concave portions for the sensor can be reduced, the frequency of the erroneous detection of the sensor can be reduced.

Preferably, the convex portion is configured by a first convex portion and a second convex portion which locate between the first concave portion and the second concave portion and between the second concave portion and the first concave portion along a rotation direction, respectively, an angle from one end to the other end of the first convex portion around the driving shaft portion along the rotation direction of the detected member is set to be smaller than the predetermined angle, and an angle from one end to the other end of the second convex portion around the driving shaft portion along the rotation direction is set to be larger than the predetermined angle.

According to such a configuration, it is prevented that the first convex portion is simultaneously detected by the first and second sensors. In contrast, the second convex portion can be simultaneously detected by the first and second sensors. Thus, since the first and second convex portions can be easily grasped, the rotation position of the motor can be controlled more accurately.

Preferably, the sensor is configured by a first sensor and a second sensor which are disposed so as to be separated by a predetermined angle therebetween around the driving shaft portion, and wherein the convex portion is configured by a first convex portion and a second convex portion which are divided by the concave portions along the rotation direction of the detected member, and the first convex portion and the second convex portion are provided over angles smaller than the predetermined angle.

According to such a configuration, it is prevented that the first convex portion is simultaneously detected by the first and second sensors. In contrast, the second convex portion can be simultaneously detected by the first and second sensors. Thus, since the first and second convex portions can be easily grasped, the rotation position of the motor can be controlled more accurately.

The concave portion may be configured by a first concave portion and a second concave portion, and the first concave portion may be notched over an angle smaller than the predetermined angle and the second concave portion may be notched over an angle larger than the predetermined angle.

According to such a configuration, it is prevented that the first and second concave portions are simultaneously detected by the first and second sensors, respectively. Thus, since the detection patterns of the concave portions for the sensor can be reduced, the frequency of the erroneous detection of the sensor can be reduced.

Preferably, a lid sensor for detecting a closed state of the lid is provided. According to such a configuration, the driving operation by the motor and the control operation by the sensors may be performed only when the lid is closed, and so the frequency of the erroneous operation can be reduced.

Preferably, a plurality of the engaging portions and a plurality of the engaged portions are provided, and the plurality of the engaging portions are operated in an interlocked manner. According to such a configuration, the lid can be locked more surely.

According to the centrifuge of the invention, the locking mechanism driven by a motor can be realized with a simplified configuration and the safety and reliability can be enhanced.

DESCRIPTION OF THE EMBODIMENTS

Figure 1:
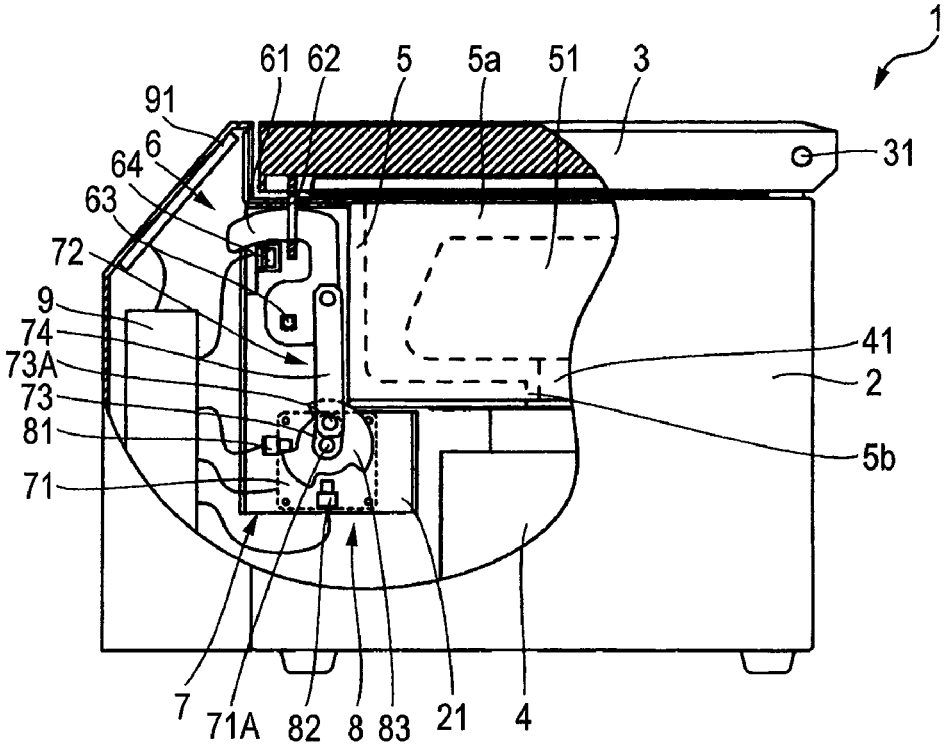
FIG. 1 is a sectional diagram of the side face portion of a centrifuge according to the embodiment of the invention.

Hereinafter, the centrifuge according to the embodiment of the invention will be explained with reference to FIGS. 1 to 6. The centrifuge 1 shown in FIG. 1 is mainly configured by a housing 2 and a lid 3. The housing 2 mainly contains therein a driving device 4, a rotation room chamber 5, a locking mechanism 6, a driving mechanism 7, a detection portion 8 and a control device 9. The housing 2 is provide therein with a first supporting portion 21 and a second supporting portion 22 (FIG. 2) which are fixed to the housing 2 and support a shaft 63 etc. described later.

The lid 3 is provided at the upper position of the housing 2 so as to cover the rotation room chamber 5 and is coupled to the housing 2 so as to be rotatable by a shaft 31. When the lid 3 is closed, a rotation room 5*a* formed within the rotation room chamber 5 as described later is closed. The lid 3 is opened with an angle in a range from 20 to 30 degree with respect to the upper surface of the housing 2 by a not-shown spring in an unlocked state.

The driving device 4 is provided at the lower portion within the housing 2 and an output shaft portion 41 for outputting a rotation force is disposed so as to be directed upward. The output shaft portion 41 is configured to protrude into the rotation room 5*a*. The driving device 4 is coupled to the housing 2 via a not-shown vibration attenuation device such as a damper.

The rotation room chamber 5 is disposed above the driving device 4. Within the rotation room chamber, a rotation room 5*a* serving as a space for disposing a rotor 51 therein is formed. A hole 5*b* is formed at the portion of the rotation room chamber 5 opposing to the driving device 4. The output shaft portion 41 protrudes into the rotation room 5*a* via the hole 5*b*. The rotor 51 is configured to be able to hold therein a plurality of not-shown vessels in each of which a sample to be centrifuged is contained. The rotor is fixed to the end portion of the output shaft portion 41 so as to rotate concentrically.

Figure 2:
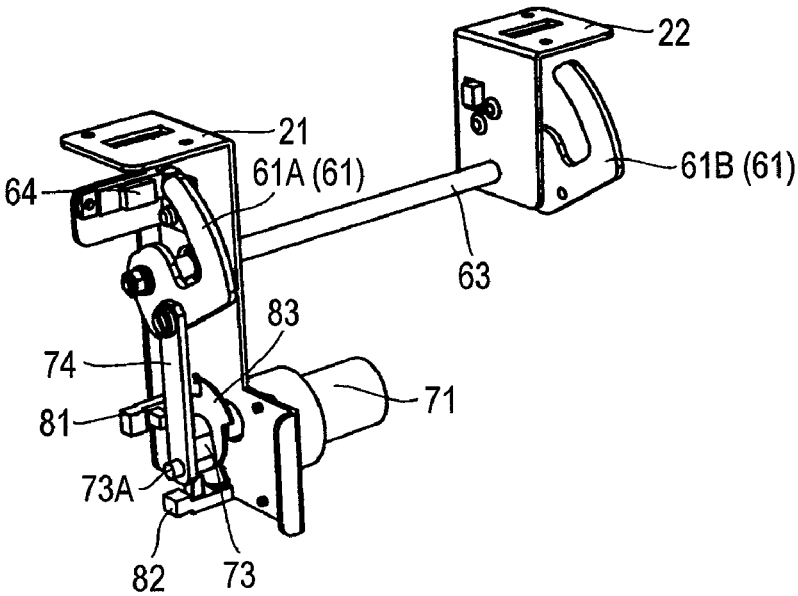
FIG. 2 is a diagram of parts showing the periphery of the driving mechanism of the centrifuge according to the embodiment of the invention.

The locking mechanism 6 is mainly configured by a hook 61 serving as an engaging portion, hook catches 62 serving as engaged portions and a lock sensor 64 serving as a lid sensor. As shown in FIG. 2, the hook 61 is configured in a manner that a first hook 61A and a second hook 61B are provided on the first supporting portion 21 side and the second supporting portion 22 side, respectively. A shaft 63 is provided between the first hook 61A and the second hook 61B so as to be fixed to the first hook 61A and the second hook 61B. Thus, when the first hook 61A is rotated around the axis center of the shaft 63, the second hook 61B can be rotated in a similar manner.

A pair of the hook catches 62 are provided at the lid 3 in correspondence to the first hook 61A and the second hook 61B, respectively. The hook 61 rotates to be placed in an engageable state and a non-engageable state with respect to the hook catches 62. The lock sensor 64 is disposed near the first hook 61A at the first supporting portion 21 and is configured so as to be able to recognize the hook catch 62 when the hook catch 62 is disposed at the position capable of being engaged with the first hook 61A.

The driving mechanism 7 is mainly configured by a motor 71 (FIG. 2) and a link mechanism 72. The motor 71 has a driving shaft portion 71A which is provided at the first supporting portion 21 in a manner that the axial direction of the driving shaft portion 71A is almost in parallel to the shaft 63. The motor 71 drives and rotates the driving shaft portion 71A in a manner that the clockwise rotation in FIG. 1 represents the positive rotation.

The link mechanism 72 is configured by a crank 73 and a rod 74. The crank 73 is fixed at its one end to the driving shaft portion 71A and has at the other end thereof a crank pin 73A extending in parallel to the axial direction of the shaft 63. The rod 74 is configured in a manner that the one end thereof is rotatable with respect to the crank pin 73A and the other end thereof is coupled to the portion of the first hook 61A away from the portion thereof where the shaft 63 is provided. Thus, the rotary movement of the driving shaft portion 71A is converted into the reciprocal movement of the rod 74 by the link mechanism 72, whereby the hook 61 can perform the reciprocal rotary movement within a predetermined angle by the reciprocal movement of the rod 74. The rod 74 is coupled to the first hook 61A in a manner that the hook 61 engages with the hook catch 62 in the deepest engagement state when the rod 74 moves to the top dead center side in the reciprocal movement, whilst the hook 61 separates from the hook catch 62 to the maximum when the rod moves to the bottom dead center side.

The detection portion 8 is mainly configured by a first sensor 81, a second sensor 82 and a disc member 83 as a member to be detected. Each of the first sensor 81 and the second sensor 82 is configured by an optical sensor which is arranged to detect an off state and the change from an on state to the off state when the disc member 83 shields a light irradiated within the sensor. Each of the sensor can also detect the on state and the change from the off state to the on state by rotating the disc member 83. The first sensor 81 and the second sensor 82 are disposed at the first supporting portion 21 in a state of being separated by a predetermined angle of 90 degree therebetween around the driving shaft portion 71A.

Figure 3:
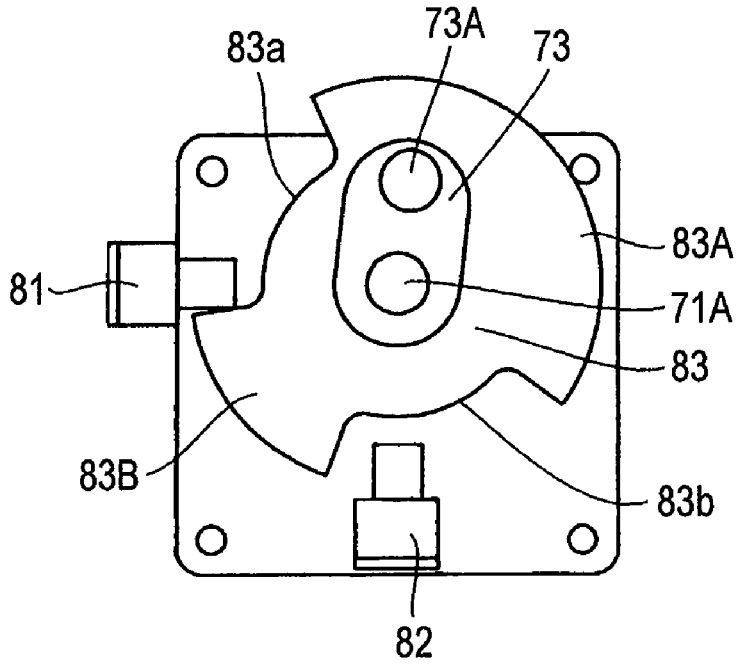
FIG. 3 is a diagram of parts showing the detection portion of the centrifuge according to the embodiment of the invention.

The disc member 83 is fixed to the driving shaft portion 71A so as to be rotatable concentrically as shown in FIG. 1 and forms a concavo-convex outer peripheral surface by a first convex portion 83A, a second convex portion 83B, a first concave portion 83*a* and a second concave portion 83*b* as shown in FIG. 3. The first convex portion 83A is disposed within a range of 150 degree around the driving shaft portion 71A. The second convex portion 83B is disposed over a range of 50 degree around the driving shaft portion 71A at the opposite side to the first convex portion 83A with respect to the driving shaft portion 71A.

The first concave portion 83*a* and the second concave portion 83*b* are formed at the one end side and the other end side in the circumferential direction of the first convex portion 83A so as to be located between the first convex portion 83A and the second convex portion 83B. Each of the first and second concave portions is formed over a range of 80 degree around the driving shaft portion 71A. When the disc member 83 is disposed so that the outer peripheral portion of the disc member 83 locates near the first sensor 81 and the second sensor 82, the first sensor 81 and the second sensor 82 can detect the first convex portion 83A to the second concave portion 83*b*. A state where the first sensor 81 and the second sensor 82 respectively detect the first concave portion 83*a* and the second concave portion 83*b* is defined as the off state, whilst a state where the first sensor 81 and the second sensor 82 respectively detect the first convex portion 83A and the second convex portion 83B is defined as the on state.

Since each of the first concave portion 83*a* and the second concave portion 83*b* are formed over the range of 80 degree whilst the first sensor 81 and the second sensor 82 are disposed so as to be separated by 90 degree therebetween around the driving shaft portion 71A, the first sensor 81 and the second sensor 82 do not simultaneously detect one of the first concave portion 83*a* and the second concave portion 83*b*.

Since the second convex portion 83B is provided over the range of 50 degree around the driving shaft portion 71A, the first sensor 81 and the second sensor 82 do not simultaneously detect the second convex portion 83B. Further, the first sensor 81 and the second sensor 82 can detect the first concave portion 83*a* and the second concave portion 83*b* respectively in a state of sandwiching the second convex portion 83B therebetween. Since the first convex portion 83A is provided over the range of 150 degree around the driving shaft portion 71A, the first sensor 81 and the second sensor 82 can simultaneously detect the first convex portion 83A.

Figure 5A:
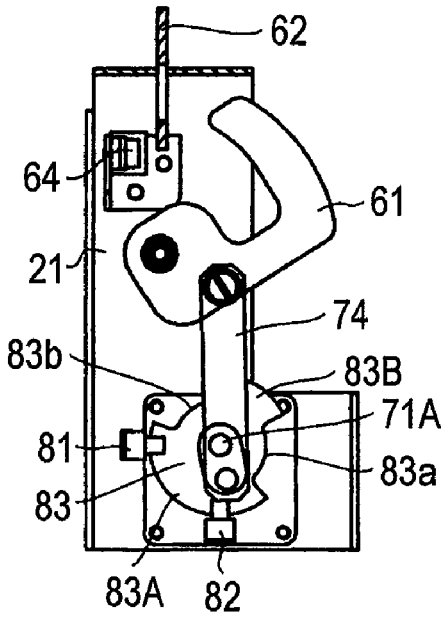
FIG. 5A is a diagram showing the operation (non-engaging state of a hook) of the detection portion of the centrifuge according to the embodiment of the invention.
Figure 5B:
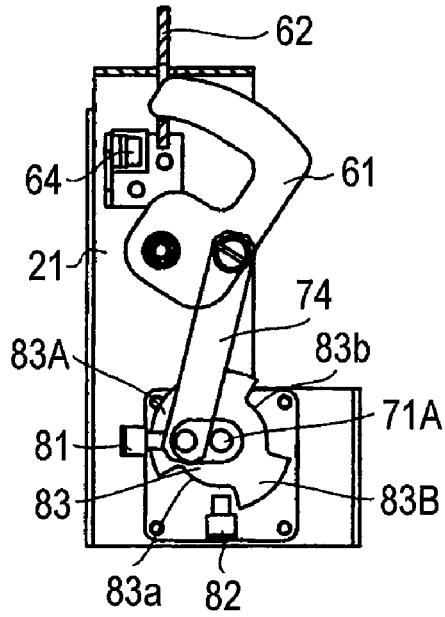
FIG. 5B is a diagram showing the operation (engaging state of the hook) of the detection portion of the centrifuge according to the embodiment of the invention.
Figure 5C:
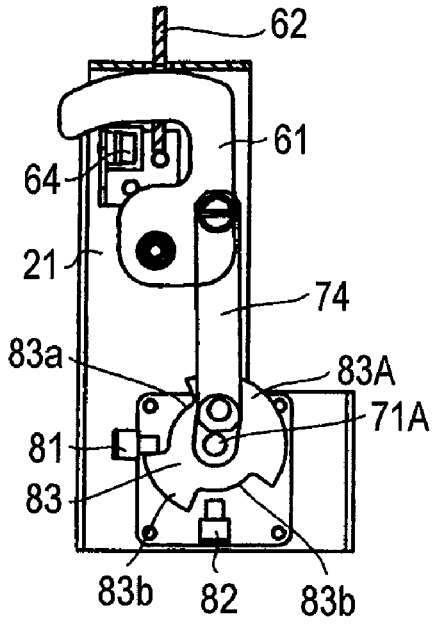
FIG. 5C is a diagram showing the operation (engaging state of the hook) of the detection portion of the centrifuge according to the embodiment of the invention.

The disc member 83 is disposed at the driving shaft portion 71A so that the first concave portion 83*a* and the second concave portion 83*b* are respectively located at the first sensor 81 and the second sensor 82 so as to sandwich the second convex portion 83B therebetween in a state where the driving shaft portion 71A rotates so as to move the rod 74 to the top dead center (FIG. 5C). Thus, in the disc member 83, the first convex portion 83A is located at the first sensor 81 and the second sensor 82 in a state where the driving shaft portion 71A rotates so as to move the rod 74 to the bottom dead center (FIG. 5A).

The control device 9 is configured to include a CPU, a RAM etc. each not shown. The control device is coupled to the lock sensor 64, the first sensor 81 and the second sensor 82 thereby to grasp the states of these sensors and also coupled to the driving device 4 and the motor 71 thereby to control the driving operations thereof. Examples of the control performed by the control device 9 will be explained. (1) The driving device 4 can be supplied with power only when the lock sensor 64 detects the lid 3 and each of the first sensor 81 and the second sensor 82 is in the on state. (2) The power supply to the motor 71 is stopped when the second sensor 82 changes from the on state to the off state in a state where the first sensor 81 detects the off state. (3) The power supply to the motor 71 is inhibited when each of the first sensor 81 and the second sensor 82 detects the off state in a state where the lock sensor 64 does not recognize that the hook catch 62 moves to the position capable of being engaged with the first hook 61A at the time of turning the main power supply of the centrifuge 1 on. (4)) The power supply to the motor 71 is stopped when the first sensor 81 changes from the off state to the on state in a state where the second sensor 82 detects the on state.

Figure 4:
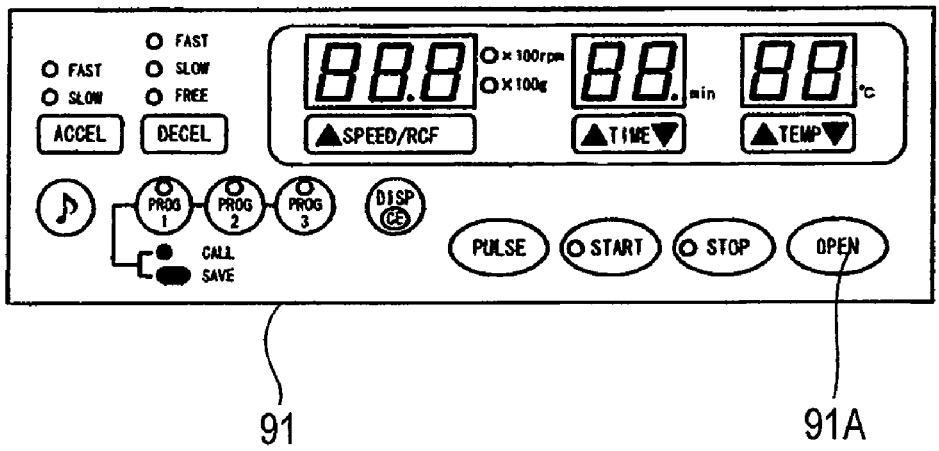
FIG. 4 is a plan view of the operation panel of the centrifuge according to the embodiment of the invention.

The control device 9 is coupled to an operation panel 91 shown in FIG. 4. The operation panel 91 is provided at the upper position of the housing 2 and displays the states of the respective sensors. The control device is provided with an open/close switch 91A relating to the locking of the lid 3 and switches for inputting the operations of the driving device 4 etc.

Hereinafter, the operation for closing the lid 3 will be explained with reference to FIGS. 5A-5D and a time chart shown in FIG. 6. In a state where each of the first sensor 81 and the second sensor 82 detects the first convex portion 83A as shown in FIG. 5A (the on state, a position A in FIG. 6), an operator pushes the lid 3 in an opened state with an angle of 20 to 30 degree thereby to close the lid. Thus, the lock sensor 64 detects the closed state of the lid 3, whereby the motor 71 is driven by the control device 9. The driving shaft portion 71A rotates in response to the driving of the motor 71, whereby the rod 74 moves upward and also the disc member 83 rotates. Thus, since a shown in FIG. 5B, the first concave portion 83*a* locates at the position of the second sensor 82, the second sensor 82 is placed in the off state (a position B in FIG. 6).

Figure 6:
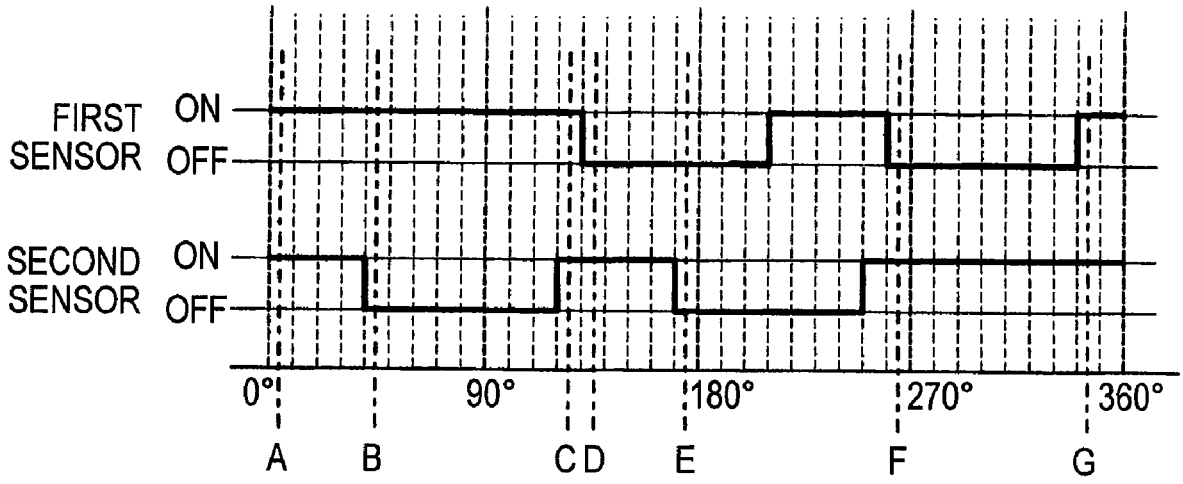
FIG. 6 is a timing-chart showing the operation of the detection portion of the centrifuge according to the embodiment of the invention.

By rotating the driving shaft portion 71A, the second convex portion 83B moves to the position of the second sensor 82 thereby to place the second sensor 82 in the on state (a position C in FIG. 6) and also the first concave portion 83*a* moves to the position of the first sensor 81 thereby to place the first sensor 81 in the off state (a position D in FIG. 6). The driving shaft portion 71A is further rotated thereby to move the second concave portion 83*b* to the position of the second sensor 82 in a state where the first concave portion 83*a* still locates at the position of the first sensor 81. In this case, since the second sensor 82 detects the change from the on state to the off state in the state where the first sensor 81 still detects the off state, the power supply to the motor 71 is stopped and so the motor 71 stops its rotation.

Since the driving shaft portion 71A is not provided with a braking device such as a brake, the driving shaft portion still rotates slightly due to its inertia even when the power supply is stopped. The first sensor 81 and the second sensor 82 are disposed so as to be separated by 90 degree therebetween around the driving shaft portion 71A and the second convex portion 83B is provided over the range of 50 degree around the driving shaft portion 71A. At the moment where the disc member moves from the second convex portion 83B to the second concave portion 83*b* at the position of the second sensor 82 (that is, the second sensor 82 changes from the on state to the off state), there is a space corresponding to about 40 degree between the first sensor 81 and the second convex portion 83B. Thus, even if the driving shaft portion 71A rotates slightly due to its inertia, the second convex portion 83B is restricted from moving to the position of the first sensor 81 (that is, the first sensor 81 becomes the on state). Therefore, after stopping the power supply to the motor 71, as shown in FIG. 5C, the first concave portion 83*a* and the second concave portion 83*b* respectively locate at the positions of the first sensor 81 and the second sensor 82, whereby the each of the first sensor 81 and the second sensor 82 is placed in the off state (a position E in FIG. 6). Since the rod 74 locates at the top dead center or near the top dead center in this state, the hook catch 62 is engaged with the hook 61 in the deepest engagement state, whereby the lid 3 is locked and placed in a state never being opened.

Figure 5D:
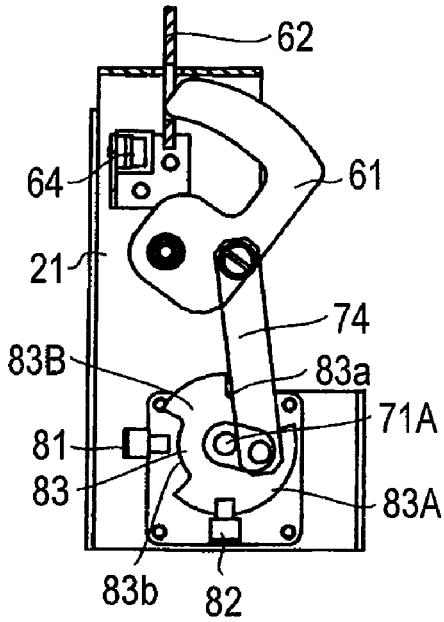
FIG. 5D is a diagram showing the operation (disengaged state of the hook) of the detection portion of the centrifuge according to the embodiment of the invention.

When the open/close switch 91A of the operation panel 91 is operated in the rotation stop state of the rotor 51 after separating a not-shown sample, the motor 71 is supplied with the power again and so the driving shaft portion 71A rotates. Simultaneously, the disc member 83 also rotates, whereby the first convex portion 83A moves to the position of the second sensor 82 and the second concave portion 83*b* moves to the position of the first sensor 81 as shown in FIG. 5D. In this state, the first sensor 81 detects the off state, whilst the second sensor 82 detects the on state (a position F in FIG. 6). When the disc member 83 rotates further, the first convex portion 83A moves to the position of the first sensor 81 (a position G in FIG. 6). Thus, since each of the first sensor 81 and the second sensor 82 detects the on state, the control device 9 stops the power supply to the motor 71 thereby to stop the rotation of the driving shaft portion 71A.

In this case, also the driving shaft portion 71A rotates slightly due to it inertia. However, since the angle of the first convex portion 83A is set to 150 degree so as to be larger than the angle (90 degree) between the first sensor 81 and the second sensor 82, the first convex portion 83A is prevented from passing the position of the second sensor 82 due to the inertial rotation, whereby the on state can be detected preferably. In this state, since the rod 74 locates at the bottom dead center or near the bottom dead center, hook 61 is separated from the hook catch 62 to the maximum. Thus, the lid 3 can be opened and a not-shown sample within the rotor can be taken out easily.

As described above, the control device 9 determines that the lid 3 is locked by the hook 61 when each of the first sensor 81 and the second sensor 82 detects the off state. Further, the control device supplies the electric power to the driving device 4 only when the lock sensor 64 detects that the lid 3 is closed. Thus, in the case where a power failure etc. occurs in a state that the lid 3 is closed and so the electric power can be supplied to the driving device 4, even in a state that the lock sensor 64 can not recognize the movement of the hook catch 62 to the engaged position and it is unknown whether the rotor 51 is in the rotating state or not, when the control device 9 determines that the lid is in the locked state, the power supply to the motor 71 is inhibited. Therefore, the opening of the lid 3 is prevented and so an accident due to the rotor 51 in a rotating state can be prevented from occurring. Since the lid 3 is not in the locked state when one of the first sensor 81 and the second sensor 82 is in the on state, the rotor 51 is never in the rotating state. Thus, the motor 71 may be supplied with the electric power and rotate to the position where the lid 3 can be opened. Therefore, by grasping the rotation position of the driving shaft portion 71A by the detection portion 8, the movement of the hook 61 can be inhibited in a state that it is dangerous to separate the hook 61 from the hook catch 62, whereby the safety can be improved.

The centrifuge according to the invention is not limited to the aforesaid embodiment and various kinds of changes and improvements can be made within a scope claimed in claims. For example, the concave portion and the convex portion may be exchanged to each other in the disc member 83. In this case, when the controls relating to the on/off states detected by the first sensor 81 and the second sensor 82 in the control device 9 are exchanged to each other, the effects similar to those of the centrifuge 1 according to the embodiment can be obtained.

What is claimed is:

1. A centrifuge, comprising:

a housing;

a rotor which is rotatable and to which a sample vessel containing a sample therein is attached;

a rotation room chamber which defines a rotation room that is provided within the housing and houses the rotor therein;

a lid capable of opening and closing the rotation room selectively;

a locking mechanism which is configured by an engaging portion which is provided at one of the housing and the lid in order to lock the lid in a closed state and an engaged portion which is provided at the other of the housing and the lid and with which the engaging portion engages;

an engaging portion driving mechanism which includes a driving portion having a driving shaft portion being driven and rotated and a link mechanism which converts a rotary movement of the driving shaft portion into a reciprocal movement and is coupled to the engaging portion; and a detection portion which detects that the engaging portion moves to a position where the engaging portion engages with the engaged portion in a closed state of the lid, wherein the detection portion includes a detected member which is fixed to the driving shaft portion and has a concavo-convex outer peripheral surface and at least one sensors for detecting a concave portion or a convex portion of the detected member, the engaging portion driving mechanism moves in an interlocked manner with a rotation of the detected member, and positions of the concave portion and the convex portion correspond to a position where the engaging portion engages with the engaged portion.

2. A centrifuge according to claim 1, wherein the sensor is configured by a first sensor and a second sensor which are disposed so as to be separated by a predetermined angle therebetween around the driving shaft portion, and wherein the concave portion is configured by a first concave portion and a second concave portion which are notched over angles smaller than the predetermined angle.

3. A centrifuge according to claim 2, wherein the convex portion is configured by a first convex portion and a second convex portion which locate between the first concave portion and the second concave portion and between the second concave portion and the first concave portion along a rotation direction, respectively, an angle from one end to the other end of the first convex portion around the driving shaft portion along the rotation direction of the detected member is set to be smaller than the predetermined angle, and an angle from one end to the other end of the second convex portion around the driving shaft portion along the rotation direction is set to be larger than the predetermined angle.

4. A centrifuge according to claim 1, wherein the sensor is configured by a first sensor and a second sensor which are disposed so as to be separated by a predetermined angle therebetween around the driving shaft portion, and wherein the convex portion is configured by a first convex portion and a second convex portion which are divided by the concave portions along the rotation direction of the detected member, and the first convex portion and the second convex portion are provided over angles smaller than the predetermined angle.

5. A centrifuge according to claim 4, wherein the concave portion is configured by a first concave portion and a second concave portion, and the first concave portion is notched over an angle smaller than the predetermined angle and the second concave portion is notched over an angle larger than the predetermined angle.

6. A centrifuge according to claim 4, wherein the predetermined angle is set to about 90 degree.

7. A centrifuge according to claim 1, further comprising a lid sensor for detecting a closed state of the lid.

8. A centrifuge according to claim 1, wherein a plurality of the engaging portions and a plurality of the engaged portions are provided, and the plurality of the engaging portions are operated in an interlocked manner.

* * * * *